United States Patent [19]

Mihayashi et al.

[11] 4,435,503

[45] Mar. 6, 1984

[54] SILVER HALIDE COLOR PHOTOGRAPHIC LIGHT-SENSITIVE MATERIAL

[75] Inventors: Keiji Mihayashi; Tadashi Ogawa; Morio Yagihara, all of Kanagawa, Japan

[73] Assignee: Fuji Photo Film Co., Ltd., Kanagawa, Japan

[21] Appl. No.: 397,746

[22] Filed: Jul. 13, 1982

[30] Foreign Application Priority Data

Jul. 13, 1981 [JP] Japan ..... 56-109056

[51] Int. Cl.[3] ..... G03C 5/24

[52] U.S. Cl. ..... 430/548; 430/505; 430/510; 430/523; 430/551; 430/554

[58] Field of Search ..... 430/372, 214, 548, 551, 430/554, 505, 523, 510

[56] References Cited

U.S. PATENT DOCUMENTS

| | | | |
|---|---|---|---|
| 3,141,771 | 7/1964 | Bard et al. | 430/214 |
| 3,770,431 | 11/1973 | Gates et al. | 430/214 |
| 4,003,748 | 1/1977 | Langen et al. | 430/551 |
| 4,080,211 | 3/1978 | Paesschen et al. | 430/548 |
| 4,367,282 | 1/1983 | Yagihara et al. | 430/548 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material containing a 4-equivalent magenta color image forming polymer coupler latex and at least one compound capable of reacting with and fixing formaldehyde gas. The silver halide color photographic light-sensitive material has good film strength and a reduced layer thickness. It is possible to avoid the decrease in color density and the formation of fog normally present when the silver halide color photographic light-sensitive material is stored for a long period of time in contact with formaldehyde gas.

21 Claims, No Drawings

SILVER HALIDE COLOR PHOTOGRAPHIC LIGHT-SENSITIVE MATERIAL

BACKGROUND OF THE INVENTION

The present invention relates to a silver halide color photographic light-sensitive material containing a 4-equivalent magenta color image forming polymer coupler latex capable of coupling with an oxidation product of an aromatic primary amine developing agent. More particularly the invention relates to a silver halide color photographic light-sensitive material containing a 4-equivalent magenta color image forming coupler which can sustain original preferred photographic properties even when it is brought into contact with formaldehyde gas during storage.

Recently, furniture and construction materials processed with formalin, adhesives containing formalin as a hardening agent, goods made of formaldehyde resins, leather goods tanned with formalin, clothes treated with formalin as a sterilizer or a bleaching agent, and the like are frequently utilized in daily life. Therefore, there are many opportunities for conventional photographic light-sensitive materials to be brought into contact with formaldehyde gas released from these daily necessities.

In general, a silver halide color photographic light-sensitive material is composed of a support having coated thereon some silver halide emulsion layers each of which has sensitivity in a different region of the spectrum and which contains a coupler capable of reacting with an oxidation product of a color developing agent to form a dye. For example, the material might contain silver halide emulsion layers each of which is sensitive to blue light, green light or red light and contains a yellow coupler, a magenta coupler or a cyan coupler, respectively, in a conventional case. After exposure to light, the photographic material is subjected to color development processing to form yellow, magenta and cyan color dye images in these silver halide emulsion layers respectively. In such a multilayer color photographic material, it is requested that each silver halide emulsion layer be well balanced with respect to sensitivity and gradation, in order to obtain an excellent color image. It is also desired that the photographic properties of the photographic material are not changed during storage for a long period of time either before or after exposure to light until it is subjected to color development processing.

However, when a conventional silver halide color photographic light-sensitive material is brought into contact with formaldehyde gas before color development processing, not only is the coupler incorporated therein consumed by the reaction with formaldehyde but an undesirable product is also formed. As a result, degradation of the photographic properties, for example, decrease in color density, increase in color stain and fog, etc., occurs. The degradation of photographic properties due to formaldehyde gas is serious in the case of the so-called 4-equivalent couplers having an active methylene group. Particularly, magenta couplers tend to be adversely affected with formaldehyde.

It has been proposed that a compound which reacts with formaldehyde be incorporated into a silver halide color photographic light-sensitive material containing a coupler for the purpose of preventing the degradation of photographic properties due to formaldehyde gas. However, known compounds for preventing the degradation of photographic properties due to formaldehyde gas in silver halide color photographic light-sensitive materials containing an oil-soluble 4-equivalent magenta coupler, as described in Japanese Patent Publication Nos. 34675/71, 38418/73 and 23908/76, U.S. Pat. No. 3,770,431, *Research Disclosure*, Vol. 101, No. 10133, etc., only have a slight ability with respect to fixing formaldehyde gas. Therefore, sufficient effects cannot be obtained. Further, when they are used in a large amount, a disadvantage is encountered. More specifically, film properties of the photographic light-sensitive material are degraded.

SUMMARY OF THE INVENTION

Therefore, an object of the present invention is to provide an extraordinarily superior silver halide color photographic light-sensitive material containing a 4-equivalent magenta color image forming polymer coupler latex in which changes in the photographic properties such as decrease in color density and increase in fog, etc., are small when the photographic light-sensitive material is brought into contact with formaldehyde gas during storage prior to color development processing.

Another object of the present invention is to provide a silver halide color photographic light-sensitive material having good film strength which contains an aldehyde scavenger in a sufficient amount for improving the resistivity to formalin.

A further object of the present invention is to provide a silver halide color photographic light-sensitive material having a reduced emulsion layer thickness and improved sharpness.

Other objects of the present invention will be apparent from the following detailed description and examples.

As a result of extensive investigations, it has now been found that these objects of the present invention are accomplished by a silver halide color photographic light-sensitive material comprising a support having thereon at least one silver halide emulsion layer, the color photographic light-sensitive material containing a 4-equivalent magenta color image forming polymer coupler latex and at least one compound capable of reacting with and fixing formaldehyde gas.

DETAILED DESCRIPTION OF THE INVENTION

In one embodiment, the silver halide color photographic light-sensitive material of the present invention comprises a support having thereon a silver halide emulsion layer containing an aqueous magenta polymer coupler latex of a homopolymer or a copolymer having a repeating unit of a color forming portion in a molecule thereof and at least one compound capable of reacting with and fixing formaldehyde gas.

The compound capable of reacting with and fixing formaldehyde gas (hereinafter referred to as a formalin scavenger) used in the present invention is represented by the following general formula (I) or (II).

$$R_1-\overset{\overset{\displaystyle H}{|}}{X}-R_2 \qquad \text{(I)}$$

-continued (II)

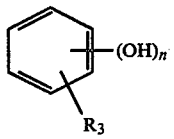

In the above formulae, $R_1$ and $R_2$, which may be the same or different, each has up to 20 carbon atoms and represents a hydrogen atom, an alkyl group (e.g., a methyl group, an ethyl group, an n-propyl group, etc.), a substituted alkyl group, an aryl group (e.g., a phenyl group, a naphthyl group, etc.), a substituted aryl group, an acyl group (e.g., an acetyl group, a malonyl group, a benzyl group, a cinnamoyl group, etc.), an alkoxycarbonyl group (e.g., a methoxycarbonyl group, an ethoxycarbonyl group, etc.), an arylcarbonyl group (e.g., a phenylcarbonyl group, etc.), a carbamoyl group, an alkylcarbamoyl group (e.g., a methylcarbamoyl group, an ethylcarbamoyl group, etc.), a dialkylcarbamoyl group (e.g., a dimethylcarbamoyl group, etc.), an arylcarbamoyl group (e.g., a phenylcarbamoyl group, etc.), an amino group, an alkylamino group (e.g., a methylamino group, an ethylamino group, etc.), or an arylamino group (e.g., a phenylamino group, a naphthylamino group, etc.), or $R_1$ and $R_2$ may be bonded to each other to form a ring and at least one of $R_1$ and $R_2$ is an acyl group, an alkoxycarbonyl group, a carbamoyl group or an amino group; and X represents —CH— or —N—; $R_3$ represents an alkyl group, a substituted alkyl group, an aryl group or a substituted aryl group or an atomic group necessary to form a monocyclic ring fused to the benzene ring; and n represents an integer of not less than 2, and has not more than 300 of an equivalent molecular weight per unit of an active hydrogen atom as defined below.

$$\text{Equivalent Molecular Weight} = \frac{\text{Molecular Weight}}{\text{Number of Active Hydrogen Atoms in Molecule}}$$

The substituents of the substituted alkyl group and substituted aryl group above include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., fluorine, chlorine, bromine, etc.), a carboxy group, a carbamoyl group (e.g., a methylcarbamoyl group, etc.), an alkoxycarbonyl group (e.g., a methoxycarbonyl group), a sulfonyl group (e.g., a methylsulfonyl group, etc.), and when there are two or more substituents, they may be the same or different.

Of the formalin scavengers represented by the general formulae (I) and (II), preferred compounds are represented by the following general formulae (I-1) to (I-7) and (II-1) to (II-2) including a compound capable of converting to an enol form.

(I-1)

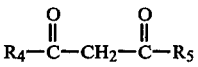

-continued (I-2)

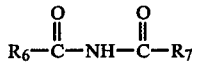

(I-3)

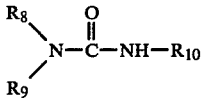

(I-4)

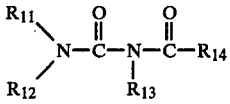

(I-5)

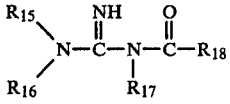

(I-6)

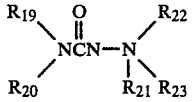

(I-7)

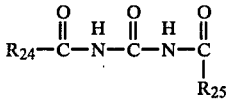

(II-1)

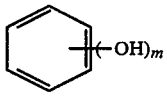

(II-2)

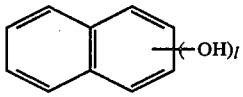

In the above formulae, $R_4$ to $R_{25}$, each has up to 20 carbon atoms and represents a hydrogen atom, an alkyl group (e.g., a methyl group, an ethyl group, an n-propyl group, etc.), a substituted alkyl group, an aryl group (e.g., a phenyl group, a naphthyl group, etc.), or a substituted aryl group. One of $R_{11}$, $R_{12}$, $R_{13}$ and $R_{14}$ and one of $R_{19}$, $R_{20}$, $R_{21}$, $R_{22}$ and $R_{23}$ each represents a hydrogen atom.

Substituents of the substituted alkyl group and substituted aryl group include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., fluorine, chlorine, bromine, etc.), a carboxy group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), and when there are two or more substituents, they may be the same or different.

$R_4$ and $R_5$, $R_6$ and $R_7$ and $R_{24}$ and $R_{25}$ may be bonded each other to form a ring. Any two substituents selected from $R_8$ to $R_{10}$, $R_{11}$ to $R_{14}$, $R_{15}$ to $R_{18}$ and $R_{19}$ to $R_{23}$ may be bonded each other to form a ring. m represents an integer of from 3 to 6 and l represents an integer of not less than 2.

Specific examples of particularly preferred formalin scavengers represented by the general formulae (I-1) to (I-7) and (II-1) to (II-2) are set forth below. However, the compounds used in the present invention are not to be construed as being limited thereto.

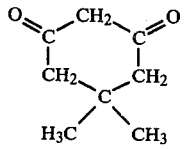

(S-1)

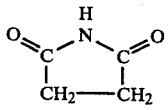

(S-2)

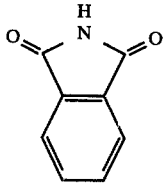

(S-3)

$NH_2CONHCH_2CH_2NHCONH_2$ (S-4)

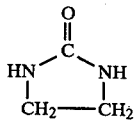

(S-5)

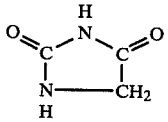

(S-6)

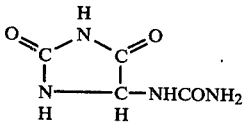

(S-7)

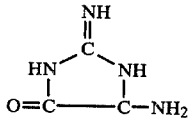

(S-8)

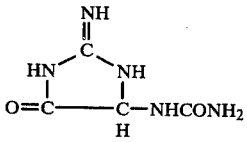

(S-9)

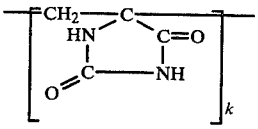

(S-10)

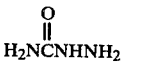

(S-11)

-continued

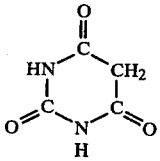

(S-12)

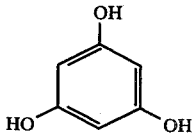

(S-13)

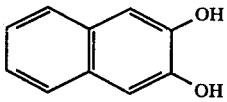

(S-14)

$CH_3CCH_2CCH_3$ (S-15)

$H_2NCNHCH_2NHCNH_2$ (S-16)

$H_2NCNH(CH_2)_3NHCNH_2$ (S-17)

$C_2H_5NHCNH_2$ (S-18)

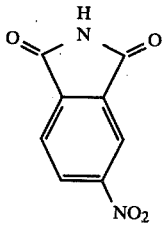

(S-19)

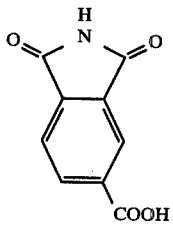

(S-20)

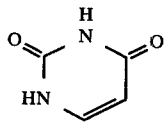

(S-21)

$CH_3CNHCNH_2$ (S-22)

$CH_3CNHC—NHCH_3$ (S-23)

$C_2H_5NHCNHNH_2$ (S-24)

$CH_3CONHCONHCOCH_3$ (S-25)

The above described Compound (S-10) is an oligomer or a polymer having the above described repeating units, a number of which is represented by k.

Formalin scavengers (S-1) to (S-6) and (S-12) to (S-23) are usually commercially available compounds. Formalin scavengers (S-7) to (S-11) can be easily synthesized according to the method as described in *Bulletin of the Chemical Society of Japan,* Vol. 39, pages 1559 to 1567 and 1734 to 1738 (1966), *Chemische der Berichte,* Vol. 54B, pages 1802 to 1833 and 2441 to 2479 (1921), *Beilstein Handbuch der Organischen Chemie,* H, page 98 (1921), etc. Formalin scavengers (S-24) and (S-25) can be synthesized by the method as described in *Beilstein Handbuch der Organischen Chemie,* First Supplemental Edition, Vol. 4, page 354, and Vol. 3, page 63, etc.

The formalin scavenger according to the present invention may be used as a mixture of two or more thereof.

The formalin scavenger used in the present invention can be incorporated into at least one layer of a silver halide color photographic light-sensitive material, such as a silver halide emulsion layer, a subbing layer, a protective layer, an intermediate layer, a filter layer, an antihalation layer and other auxiliary layers. The objects of the present invention can be attained by adding the formalin scavenger to any of a silver halide emulsion layer containing a magenta polymer coupler latex, the photographic properties of which are degraded in contact with formaldehyde gas, a layer which is positioned closer to the support than the silver halide emulsion layer and a layer which is positioned further away from the support than the silver halide emulsion layer.

In order to incorporate the formalin scavenger used in the present invention into the photographic layer, the compound can be added to a coating solution for the layer directly or by dissolving it in a solvent which does not impart adverse effects to the silver halide color photographic light-sensitive material, for example, water, an alcohol, etc., in an appropriate concentration. Also, the formalin scavenger can be added by dissolving the compound in a high boiling point organic solvent and/or a low boiling point organic solvent and dispersing the solution into an aqueous solution. The formalin scavenger can be added at any period of time during the production of the color photographic light-sensitive material. However, it is generally desirable that the compound is added just before coating. Generally, the formalin scavenger is added in an amount of from 0.01 g to 10 g, and preferably from 0.05 to 5 g; per square meter of the silver halide color photographic light-sensitive material.

The 4-equivalent magenta color image forming polymer coupler latex which can be used in the present invention is preferably a polymer having a repeating unit derived from a monomer coupler represented by the general formula (III) described below, or a copolymer of a repeating unit derived from a monomer coupler represented by the general formula (III) described below and at least one non-color forming monomer having at least one ethylene group which does not have the ability to carry out oxidative coupling with an aromatic primary amine developing agent.

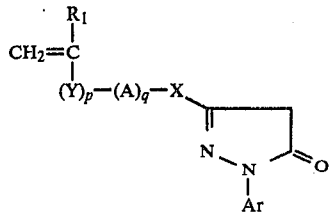

(III)

wherein R represents a hydrogen atom, a lower alkyl group containing from 1 to 4 carbon atoms or a chlorine atom; X represents —CONH—, —NH—, —NHCONH— or —NHCOO—; Y represents —CONH— or —COO—; A represents an unsubstituted or substituted alkylene group having from 1 to 10 carbon atoms, which may be a straight chain or a branched chain (for example, a methylene group, a methylmethylene group, a dimethylmethylene group, a dimethylene group, a trimethylene group, a pentamethylene group, a decylmethylene group, etc.) or an unsubstituted or substituted phenylene group.

Substituents for the alkylene group or the phenylene group represented by A include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Ar represents an unsubstituted or substituted phenyl group. Substituents for the phenyl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents include a halogen atom, an alkyl group, an alkoxy group, an alkoxycarbonyl group and a cyano group.

p represents 0 or 1, and q represents 0 or 1.

Examples of the non-color forming monomer which does not couple with the oxidation product of an aromatic primary amine developing agent include an ester, preferably a lower alkyl ester and an amide, derived from an acrylic acid, for example, acrylic acid, α-chloroacrylic acid, α-alkylacrylic acid such as methacrylic acid, for example, acrylamide, methacrylamide, t-butylacrylamide, methyl acrylate, ethyl acrylate, n-propyl acrylate, n-butyl acrylate, 2-ethylhexyl acrylate, n-hexyl acrylate, octyl methacrylate, lauryl methacrylate, methylene bisacrylamide, etc., a vinyl ester, for example, vinyl acetate, vinyl propionate, vinyl laurate, etc., acrylonitrile, methacrylonitrile, an aromatic vinyl compound, for example, styrene and a derivative thereof, for example, vinyl toluene, divinyl benzene, vinyl acetophenone, sulfo styrene, etc., itaconic acid, citraconic acid, crotonic acid, vinylidene chloride, a vinyl alkyl ether, for example, vinyl ethyl ether, an ester of maleic acid, N-vinyl-2-pyrrolidone, N-vinyl pyridine, 2- or 4-vinyl pyridine, etc.

Of these monomers, an ester of acrylic acid, an ester of methacrylic acid and an ester of maleic acid are particularly preferred.

Two or more comonomer compounds described above can be used together with. For example, a combination of n-butyl acrylate and divinyl benzene, styrene and methacrylic acid, n-butyl acrylate and methacrylic acid, etc., can be used.

The ethylenically unsaturated monomer which is used to copolymerize with the monomer coupler represented by the above-described general formula (III) can be selected to that the copolymer to be formed possesses good physical properties and/or chemical properties, for example, solubility, compatibility with a binder such as gelatin in a photographic colloid compositions, flexibility, heat stability, etc., as well known in the field of polymer color couplers.

The magenta polymer coupler latex used in the present invention can be prepared by dissolving a lipophilic polymer coupler obtained by polymerization of a monomer coupler, in an organic solvent and then dispersing the solution in a latex form in an aqueous gelatin solution, by directly dispersing a solution of a lipophilic polymer coupler obtained by polymerization of a monomer coupler or by dissolving a solid lipophilic polymer coupler once collected in an organic solvent and then dispersing the solution in a latex form. Alternatively, a latex prepared by an emulsion polymerization method may be directly added to a gelatin silver halide emulsion.

With respect to the former case in which a lipophilic polymer coupler is dispersed in a latex form in an aqueous gelatin solution, the method as described in U.S. Pat. No. 3,451,820 can be used. With respect to the latter case in which a latex prepared by an emulsion polymerization method is directly added, the method as described in U.S. Pat. Nos. 4,080,211, 3,370,952, 3,926,436 and 3,767,412, and British Pat. No. 1,247,688 can be used.

These methods can be applied to preparation of homopolymers and preparation of copolymers. In the latter case, a non-color forming comonomer is preferably a liquid comonomer which may act, in the case of the emulsion polymerization, as a solvent for a monomer which is solid in normal state.

Free radical polymerization of an ethylenically unsaturated solid monomer is initiated with the addition to the monomer molecule of a free radical which is formed by thermal decomposition of a chemical initiator, an action of a reducing agent to an oxidative compound (a redox initiator) or a physical action with, for example, ultraviolet rays or other high energy radiations, high frequencies, etc.

Examples of the chemical initiators commonly used include a water-soluble initiator, for example, a persulfate (such as ammonium persulfate, potassium persulfate, etc.), hydrogen peroxide, 4,4'-azobis(4-cyanovaleric acid), etc., and a water-insoluble initiator, for example, azoisobutyronitrile, benzoyl peroxide, chlorobenzoyl peroxide, and other compounds. Examples of the redox initiators usually used include hydrogen peroxide-iron (II) salt, potassium persulfate-potassium hydrogensulfate, cerium salt-alcohol, etc. Specific examples and functions of the initiators are described in F. A. Bovey, *Emulsion Polymerization,* pages 59 to 93 (Interscience Publishers, Inc., New York (1955)).

The organic solvent which is used for dissolving a lipophilic polymer coupler when the lipophilic polymer coupler is dispersed in a latex form in an aqueous gelatin solution is removed from the mixture before coating of the dispersion solution. The solvent may also be removed by vaporization during drying of the dispersion solution coated, although this process is less preferable. With respect to removing the solvent, a method in which the solvent is removed by washing a gelatin noodle with water is used when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, ketone, halogenated hydrocarbon (for example, methylene chloride, trichloroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the lipophilic polymer coupler. Ionic surface active agents, and particularly anionic surface active agents, are preferred. Amphoteric surface active agents such as C-cetyl betaine, an N-alkylaminopropionate, an N-alkyliminodipropionate, etc., can be used.

The emulsifier used in the emulsion polymerization is a compound having surface activity. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16 to 20 (1963).

In order to increase the dispersion stability, control the color hue of a dye formed from a polymer coupler latex dispersed and the oxidation product of an aromatic primary amine developing agent and improve the bending property of the emulsion coated, a permanent solvent, that is, a water-immiscible organic solvent having a high boiling point (i.e., above 200° C.), may be added in a small amount (i.e., not more than 50% by weight based on the polymer coupler). The concentration of the permanent solvent must be at such a low level that the copolymer is plasticized while it is maintained in solid particle form. Furthermore, it is desirable to use the permanent solvent in a relatively low concentration in order to reduce the thickness of a final emulsion layer as much as possible to obtain good sharpness.

It is desirable if the ratio of the color forming portion in the polymer coupler latex is usually from 5 to 80% by weight. Particularly, a ratio from 20 to 70% by weight is preferred in view of color reproducibility, color forming property and stability. In this case, an equivalent molecular weight, that is, a gram number of the polymer containing 1 mol of a coupler monomer is preferably from about 250 to 3,000, but it is not limited thereto.

Preferred specific examples of the coupler monomers used in the present invention are set forth below, but the present invention is not be be construed as being limited thereto.

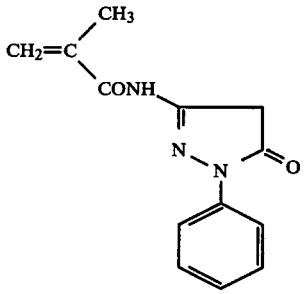
(1)

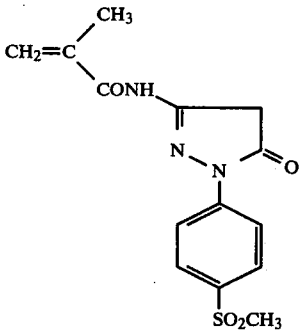
(2)

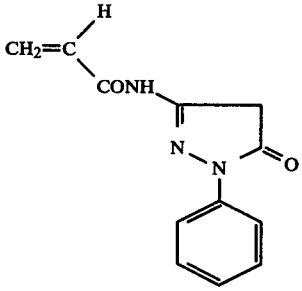
(3)

-continued

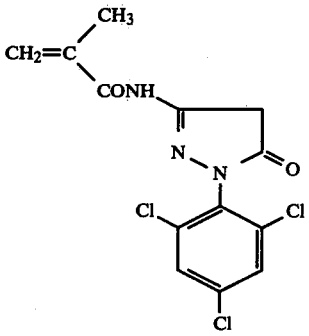
(4)

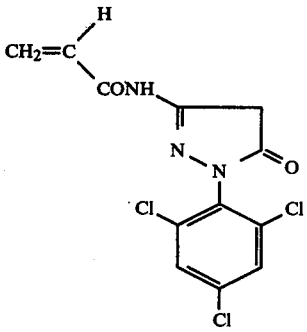
(5)

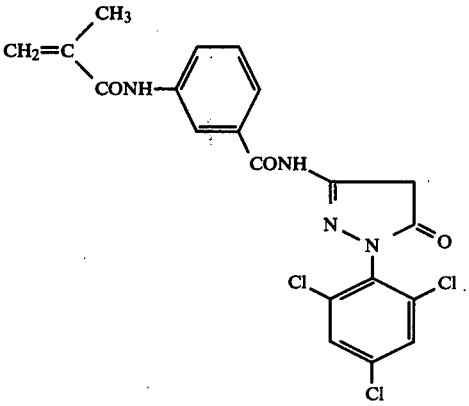
(6)

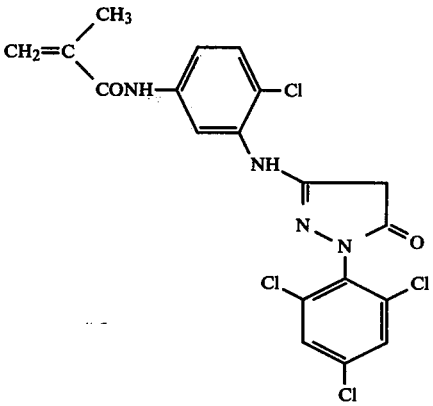
(7)

-continued
(8)
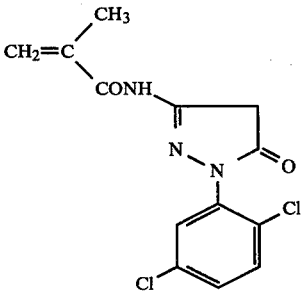
(9)
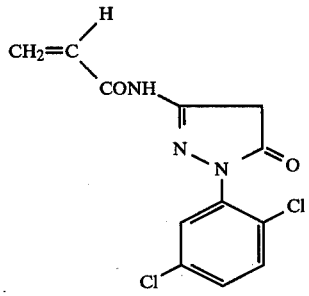
(10)
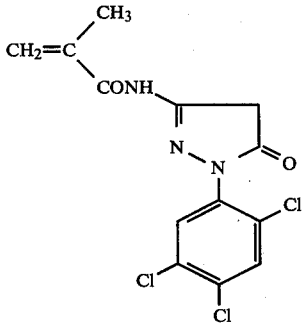
(11)
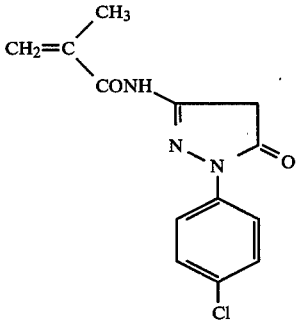
(12)
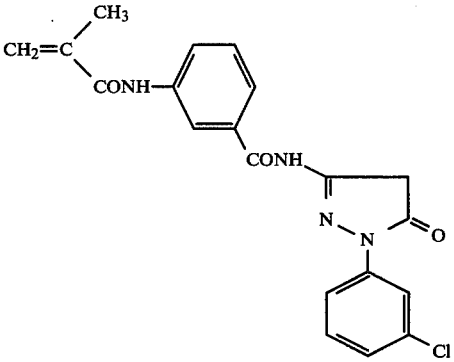
-continued
(13)
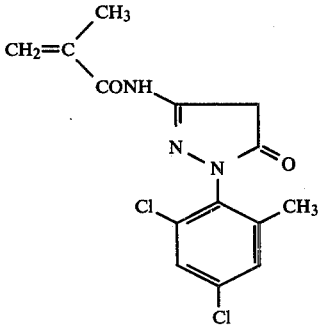
(14)
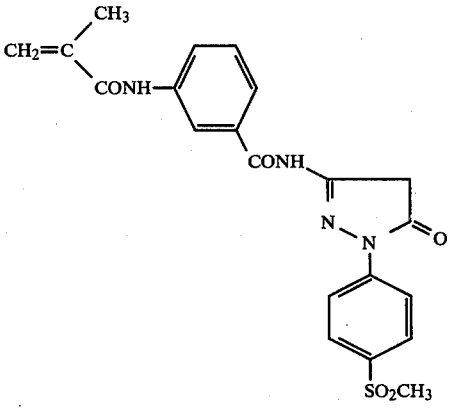
(15)
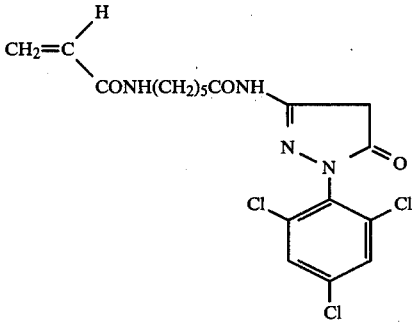
(16)
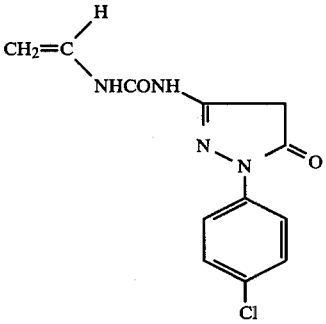
(17)
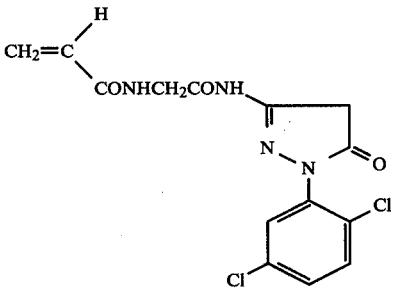

-continued (18)

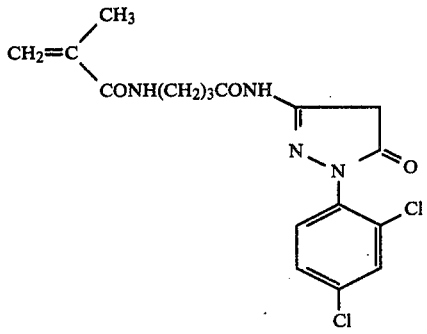

(19)

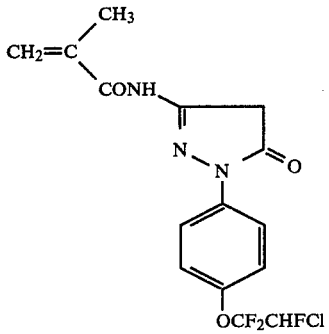

(20)

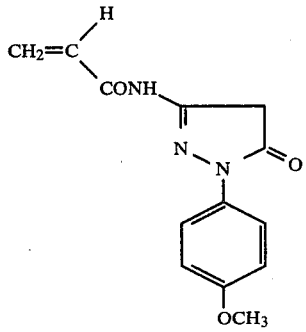

(21)

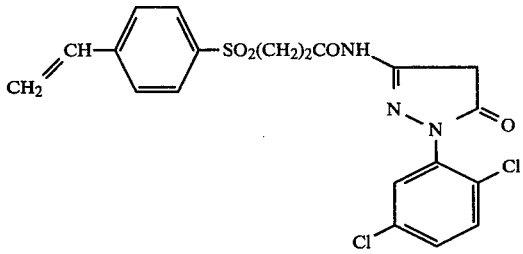

(22)

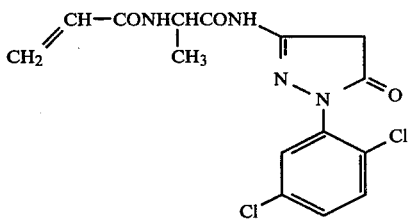

-continued (23)

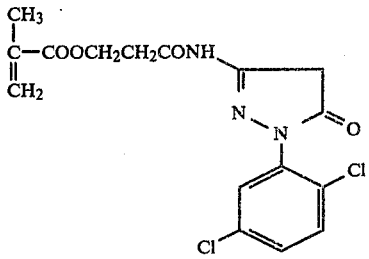

(24)

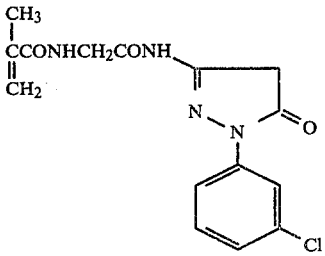

(25)

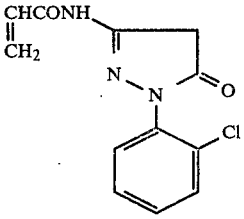

Typical synthesis examples of the coupler compounds used in the present invention are set forth below.

A. Monomer Compounds

SYNTHESIS EXAMPLE 1

Synthesis of 1-(2,4,6-trichlorophenyl)-3-(2'-chloro-5'-methacryloylaminoanilino)-2-pyrazolin-5-one [Coupler Monomer (7)]

101 g (0.25 mol) of 1-(2,4,6-trichlorophenyl)-3-(2'-chloro-5'-aminoanilino)-2-pyrazolin-5-one and 81 ml (1.0 mol) were added to 500 ml of acetonitrile to which was gradually added dropwise 65.4 g (0.63 mol) of methacryloyl chloride while cooling with ice with stirring. After reacting for about 30 minutes, 750 ml of water was added to the mixture and the crystals thus deposited were collected by filtration to obtain 141 g of 1-(2,4,6-trichlorophenyl)-3-(2'-chloro-5'-methacrylamidoanilino)-5-methacryloyloxypyrazole. The crystals were then dispersed in 400 ml of methanol, to which was gradually added 400 ml of a methanol solution containing 17 g (0.3 mol) of potassium hydroxide while cooling with ice and the mixture was stirred for 15 minutes. The mixture was neutralized with acetic acid, to which was added 1.2 l of water and the crystals thus deposited were collected by filtration. By recrystallization from acetonitrile, 74.5 g (63.7% yield) of Coupler Monomer (7) was obtained.

Melting Point: 212° to 214° C.

| Elemental Analysis for $C_{19}H_{14}N_4O_2Cl_4$ | | | |
|---|---|---|---|
| | H | C | N |
| Calculated (%): | 2.99 | 48.31 | 11.86 |

-continued

| Elemental Analysis for $C_{19}H_{14}N_4O_2Cl_4$ | | | |
|---|---|---|---|
| | H | C | N |
| Found (%): | 3.00 | 48.21 | 11.92 |

SYNTHESIS EXAMPLE 2

Synthesis of
1-(2,4,6-trichlorophenyl)-3-acryloylamino-2-pyrazolin-5-one [Coupler Monomer (5)]

224 g (0.8 mole) of 3-amino-1-(2,4,6-trichlorophenyl)-2-pyrazolin-5-one was dissolved in 3.5 l of tetrahydrofuran to which were added 144 ml (1.76 mol) of pyridine and 12 ml of nitrobenzene. To the mixture was gradually added dropwise 160 g (1.76 mol) of acryloyl chloride while cooling with ice and the mixture was stirred for about 2 hours. After adding 1 l of water, the mixture was extracted with 1.5 l of ethyl acetate, and the extract was dried with anhydrous sodium sulfate. After distilling off the solvent at fro 20° C. to 30° C. under reduced pressure, the residual oily product was dissolved in a mixture of 500 ml of water and 500 ml of ethanol, to which was then added 50 ml of an aqueous ammonia solution at room temperature. After stirring for 30 minutes, acetic acid was added to the mixture for neutralization and the crystals thus deposited were collected by filtration. By recrystallization from acetonitrile, 83 g (32% yield) of Coupler Monomer (5) was obtained.

Melting Point: 209° to 210° C.

| Elemental Analysis for $C_{12}H_8N_3O_2Cl_3$ | | | |
|---|---|---|---|
| | H | C | N |
| Calculated (%): | 2.42 | 43.33 | 12.63 |
| Found (%): | 2.51 | 43.29 | 12.84 |

SYNTHESIS EXAMPLE 3

Synthesis of
1-(2,5-dichlorophenyl)-3-methacryloylamino-2-pyrazolin-5-one [Coupler Monomer (8)]

30 g (0.12 mol) of 3-amino-1-(2,5-dichlorophenyl)-2-pyrazolin-5-one was dissolved in 250 ml of tetrahydrofuran to which were added 21 ml (0.27 mol) of pyridine and 2.5 ml of nitrobenzene. To the mixture there was further added dropwise 28.2 g (0.27 mol) of methacryloyl chloride while cooling with ice and the mixture was stirred for about 30 minutes. After adding 250 ml of water, the mixture was extracted with ethyl acetate and the extract was dried with anhydrous sodium sulfate. After distilling off the solvent at from 20° C. to 30° C. under a reduced pressure, the residual oily product was dissolved in a mixture of 360 ml of water and 200 ml of ethanol, to which was then added dropwise an aqueous solution containing 14.8 g (0.37 mol) of sodium hydroxide dissolved in 50 ml of water at room temperature. After stirring for 30 minutes, acetic acid was added to the mixture for neutralization and the crystals thus deposited were collected by filtration. By recrystallization from acetonitrile, 19.5 g (52% yield) of Coupler Monomer (8) was obtained.

Melting point: 179° to 180° C.

| Elemental Analysis for $C_{12}H_{11}N_3O_2Cl_2$ | | | |
|---|---|---|---|
| | H | C | N |
| Calculated (%): | 3.55 | 49.06 | 13.46 |
| Found (%): | 3.54 | 49.33 | 13.53 |

SYNTHESIS EXAMPLE 4

Synthesis of
1-(2,5-dichlorophenyl)-3-acryloylamino-2-pyrazolin-5-one [Coupler Monomer (9)]

48.8 g (0.2 mol) of 3-amino-1-(2,5-dichlorophenyl)-2-pyrazolin-5-one was added to 300 ml of acetonitrile to which was added dropwise 30.4 g (0.24 mol) of β-chloropropionyl chloride while heating at from 60° C. to 70° C. with stirring. After refluxing by heating for about 1 hour, the mixture was cooled to about 25° C. and the crystals thus deposited were collected by filtration to obtain 48 g (80% yield) of 1-(2,5-dichlorophenyl)-3-(β-chloropropanoylamino)-2-pyrazolin-5-one.

Then, 33.5 g (0.1 mol) of the β-chloropropanoylamino compound thus obtained was added to 150 ml of methanol and to the solution was added dropwise a solution containing 16.8 g (0.3 mol) of potassium hydroxide dissolved in 150 ml of methanol while cooling with ice. After stirring for about 30 minutes, acetic acid was added to the mixture for neutralization and 500 ml of water was added to the mixture. The crystals thus deposited were collected by filtration and recrystallized from acetonitrile to obtain 22.5 g (75% yield) of Coupler Monomer (9).

Melting Point: 201° to 202° C.

| Elemental Analysis for $C_{12}H_9N_3O_2Cl_2$ | | | |
|---|---|---|---|
| | H | C | H |
| Calculated (%): | 3.04 | 48.34 | 14.09 |
| Found (%): | 3.09 | 48.33 | 14.30 |

B. Polymer Compounds
Synthesis Method I

SYNTHESIS EXAMPLE 5

Copolymer latex of
1-(2,5-dichlorophenyl)-3-methacryloylamino-2-pyrazolin-5-one [Coupler Monomer (8)] and n-butyl acylate [Polymer Coupler Latex (A')]

Synthesis of Lipophilic Polymer Coupler (A)

To a mixture of 20 g of Coupler Monomer (8), 20 g of n-butyl acrylate and 150 ml of dioxane was added 350 mg of azobisisobutyronitrile dissolved in 10 ml of dioxane while heating at 60° C. with stirring and the mixture was heated for about 5 hours followed by continuously heating at 90° C. for 2 hours. The resulting solution was then poured into 2 l of ice water and the solid thus deposited was collected by filtration and thoroughly washed with water. By drying the solid under a reduced pressure with heating, 38.4 g of Lipophilic Polymer Coupler (A) was obtained. It was found that the lipophilic polymer coupler contained 55.1% of Coupler Monomer (8) in the copolymer synthesized as the result of nitrogen analysis.

A method for dispersing Lipophilic Polymer Coupler (A) in a latex form in an aqueous gelatin solution is described below.

Synthesis of Polymer Coupler Latex (A')

Two solutions (a) and (b) were prepared in the following manner.

Solution (a): 300 g of a 5% by weight aqueous solution of bone gelatin (pH of 5.6 at 35° C.) was heated to 38° C., to which was added 12 ml of a 10% by weight aqueous solution of sodium lauryl sulfate.

Solution (b): 20 g of the lipophilic polymer coupler described above was dissolved in 60 g of ethyl acetate at 38° C.

Solution (b) was put into a mixer with explosion preventing equipment while stirring at a high speed to which was rapidly added Solution (a). After stirring for 1 minute, the mixer was stopped and ethyl acetate was removed by distillation under a reduced pressure. Thus the lipophilic polymer coupler was dispersed in a diluted gelatin solution to prepare Polymer Coupler Latex (A').

SYNTHESIS EXAMPLE 6

Copolymer latex of 1-(2,4,6-trichlorophenyl)-3-acryloylamino-2-pyrazolin-5-one [Coupler Monomer (5)] and ethyl acrylate [Polymer Coupler Latex (B')]

Synthesis of Lipophilic Polymer Coupler (B)

To a mixture of 20 g of Coupler Monomer (5), 20 g of ethyl acrylate and 150 ml of tertiary butanol was added 350 mg of azobisisobutyronitrile dissolved in 10 ml of tertiary butanol while refluxing by heating with stirring and the mixture was refluxed by heating for about 3 hours. The resulting solution was then poured into 2 l of ice water and the solid thus deposited was collected by filtration and thoroughly washed with water. By drying the solid under a reduced pressure by heating, 35.2 g of Lipophilic Polymer Coupler (B) was obtained. It was found that the lipophilic polymer coupler contained 51.3% of Coupler Monomer (5) in the copolymer synthesized as the result of nitrogen analysis.

Synthesis of Polymer Coupler Latex (B')

Two solutions (a) and (b) were prepared in the following manner.

Solution (a): 200 g of a 3.0% by weight aqueous solution of bone gelatin (pH of 5.6 at 35° C.) was heated to 38° C., to which was added 16 ml of a 10% by weight aqueous solution of sodium lauryl sulfate.

Solution (b): 20 g of Lipophilic Polymer Coupler (B) described above was dissolved in 200 ml of ethyl acetate at 38° C.

Solution (b) was put into a mixer with explosion preventing equipment while stirring at a high speed to which was rapidly added Solution (a). After stirring for 1 minute, the mixer was stopped and ethyl acetate was removed by distillation under a reduced pressure. Thus the lipophilic polymer coupler was dispersed in a diluted gelatin solution to prepare Polymer Coupler Latex (B').

Synthesis Method II

SYNTHESIS EXAMPLE 7

Copolymer latex of 1-(2,5-dichlorophenyl)-3-methacryloylamino-2-pyrazolin-5-one [Coupler Monomer (8)] and ethyl acrylate [Polymer Coupler Latex (I)]

2 l of an aqueous solution containing 2 g of sodium salt of oleyl methyl tauride was stirred and heated to 95° C. while gradually introducing nitrogen gas through the solution. To the mixture was added 40 ml of an aqueous solution containing 280 mg of potassium persulfate dissolved. 20 g of ethyl acrylate and 20 g of Coupler Monomer (8) were dissolved by heating in 400 ml of ethanol and the resulting solution was added to the above described aqueous solution at an interval of about 30 minutes while preventing the deposition of crystals. After the completion of the addition, the mixture was heated at from 85° C. to 95° C. with stirring for 45 minutes, to which was then added 40 ml of an aqueous solution containing 120 mg of potassium persulfate dissolved. After being reacted for 1 hour, the ethanol and the ethyl acrylate not reacted were distilled off as an azeotropic mixture with water. The latex thus formed was cooled, pH of which was adjusted to 6.0 with a 1 N sodium hydroxide solution and filtered. The concentration of the polymer in the latex was 11.03% and it was found that the copolymer synthesized contained 51.3% of 1-(2,5-dichlorophenyl)-3-methacryloylamino-2-pyrazolin-5-one as the result of nitrogen analysis.

SYNTHESIS EXAMPLE 8

Copolymer latex of 1-(2,5-dichlorophenyl)-3-methacryloylamino-2-pyrazolin-5-one [Coupler Monomer (8)] and n-butyl acrylate [Polymer Coupler Latex (II)]

270 mg of an aqueous solution containing 1.54 g of sodium salt of oleyl methyl tauride dissolved was stirred and heated to 95° C. while gradually introducing nitrogen gas through the solution. To the mixture were added 20 ml of an aqueous solution containing 28 mg of potassium persulfate dissolved, and then 2.8 g of n-butyl acrylate. The mixture was polymerized by heating at from 85° C. to 95° C. with stirring for about 1 hour to prepare Latex (a). Then, to Latex (a) were added 14 g of Coupler Monomer (8), 100 ml of methanol and 10 ml of a methanol solution containing 14 g of n-butyl acrylate dissolved. To the mixture was then added 50 ml of an aqueous solution containing 196 mg of potassium persulfate dissolved and the mixture was polymerized by heating with stirring. After being reacted for 1 hour, 30 ml of an aqueous solution containing 84 mg of potassium persulfate was further added to the mixture and the mixture was continuously reacted for 1.5 hours. The methanol and the n-butyl acrylate not reacted were distilled off as an azeotropic mixture with water. The latex thus-formed was cooled, pH of which was adjusted to 6.0 with 1 N sodium hydroxide solution and filtered. The concentration of the polymer in the latex was 10.2% and it was found that the copolymer synthesized contained 43.5% of 1-(2,5-dichlorophenyl)-3-methacryloylamino-2-pyrazolin-5-one as the result of nitrogen analysis.

SYNTHESIS EXAMPLES 9 TO 30

Using the above described coupler monomers, the lipophilic magenta polymer couplers described below were prepared in the same manner as described for the copolymers in Synthesis Examples 5 and 6 (Synthesis Method I).

Lipophilic Polymer Couplers by Synthesis Method I

| Synthesis Example | Lipophilic Polymer Coupler | Coupler Monomer | Amount (g) | Comonomer*1 | Amount (g) | Coupler Monomer Unit in Polymer (%) |
|---|---|---|---|---|---|---|
| 9 | (C) | (1) | 20 | BA | 20 | 48.4 |
| 10 | (D) | (1) | 20 | EA | 80 | 20.1 |
| 11 | (E) | (2) | 10 | BMA | 40 | 20.5 |
| 12 | (F) | (3) | 20 | HA | 20 | 49.7 |
| 13 | (G) | (4) | 10 | BA | 40 | 20.7 |
| 14 | (H) | (5) | 10 | BA | 10 | 51.8 |
| 15 | (I) | (6) | 10 | MMA | 10 | 50.7 |
| 16 | (J) | (7) | 10 | BA | 10 | 51.3 |
| 17 | (K) | (7) | 10 | MA | 10 | 52.8 |
| 18 | (L) | (8) | 10 | EA | 10 | 51.0 |
| 19 | (M) | (9) | 10 | BA | 40 | 20.3 |
| 20 | (N) | (10) | 10 | BMA | 10 | 49.4 |
| 21 | (O) | (11) | 10 | EA | 20 | 32.1 |
| 22 | (P) | (12) | 10 | MMA | 10 | 49.8 |
| 23 | (Q) | (13) | 10 | BA | 10 | 49.1 |
| 24 | (R) | (15) | 10 | BA | 10 | 51.1 |
| 25 | (S) | (16) | 10 | HA | 20 | 35.2 |
| 26 | (T) | (18) | 10 | BA | 10 | 50.8 |
| 27 | (U) | (20) | 10 | EA | 40 | 21.4 |
| 28 | (V) | (21) | 10 | BA | 10 | 48.7 |
| 29 | (W) | (23) | 10 | EA | 20 | 34.6 |
| 30 | (X) | (25) | 10 | BA | 10 | 51.7 |

*1MA: Methyl Acrylate
EA: Ethyl Acrylate
BA: n-Butyl Acrylate
HA: n-Hexyl Acrylate
MMA: Methyl Methacrylate
BMA: n-Butyl Methacrylate
OMA: n-Octyl Methacrylate These lipophilic polymer couplers can be dispersed in the same manner as described in Synthesis Examples 5 and 6 to prepare latexes. Specific examples are described in the examples described hereinafter.

SYNTHESIS EXAMPLES 31 TO 46

Using the above described coupler monomers, the magenta polymer coupler latexes described below were prepared in the same manner as described for the copolymers in Synthesis Examples 7 and 8 (Synthesis Method II).

Polymer Coupler Latexes by Synthesis Method II

| Synthesis Example | Polymer Coupler Latex | Coupler Monomer | Amount (g) | Comonomer*1 | Amount (g) | Coupler Monomer Unit in Polymer (%) |
|---|---|---|---|---|---|---|
| 31 | (III) | (1) | 20 | BA | 20 | 48.4 |
| 32 | (IV) | (3) | 20 | OMA | 20 | 49.7 |
| 33 | (V) | (4) | 20 | BA | 80 | 21.2 |
| 34 | (VI) | (5) | 20 | MA | 20 | 54.5 |
| 35 | (VII) | (7) | 20 | BA | 20 | 48.8 |
| 36 | (VIII) | (8) | 20 | EA | 25 | 40.3 |
| 37 | (IX) | (9) | 10 | EA | 10 | 51.4 |
| 38 | (X) | (11) | 10 | MA | 10 | 32.1 |
| 39 | (XI) | (13) | 10 | HA | 20 | 35.0 |
| 40 | (XII) | (15) | 10 | BA | 10 | 51.1 |
| 41 | (XIII) | (18) | 10 | BA | 10 | 49.5 |
| 42 | (XIV) | (20) | 10 | EA | 10 | 52.3 |
| 43 | (XV) | (22) | 10 | BA | 40 | 21.2 |
| 44 | (XVI) | (23) | 10 | BA | 10 | 48.5 |
| 45 | (XVII) | (24) | 10 | MMA | 10 | 50.6 |

-continued

Polymer Coupler Latexes by Synthesis Method II

| Synthesis Example | Polymer Coupler Latex | Coupler Monomer | Amount (g) | Comonomer*1 | Amount (g) | Coupler Monomer Unit in Polymer (%) |
|---|---|---|---|---|---|---|
| 46 | (XVIII) | (25) | 10 | HA | 10 | 47.9 |

*1MA: Methyl Acrylate
EA: Ethyl Acrylate
BA: n-Butyl Acrylate
HA: n-Hexyl Acrylate
BMA: n-Butyl Methacrylate
OMA: n-Octyl Methacrylate The 4-equivalent magenta polymer coupler latexes according to the present invention can be used individually or as mixtures of two or more thereof.

Further, a dispersion which is prepared by dispersing a hydrophobic magenta color forming coupler, for example, a magenta coupler, as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78 (the term "OPI" as used herein refers to a "published unexamined Japanese patent application"), etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the 4-equivalent magenta polymer coupler latex according to the present invention in a manner as described in Japanese Patent Application (OPI) No. 39853/76, etc., and the resulting latex can be used. The above described hydrophobic magenta coupled is loaded into the 4-equivalent magenta polymer coupler latex in a manner as described in Japanese Patent Application (OPI) Nos. 59942/76 and 32552/79, U.S. Pat. No. 4,199,363, etc., and the resulting latex can be used. The term "load" used herein refers to the state in which the hydrophobic magenta coupler is incorporated into the interior of the magenta polymer coupler latex, or a state in which the hydrophobic magenta coupler is deposited on the surface of the magenta polymer coupler latex. However, it has not been accurately known in what kind of mechanism the load occurs.

Furthermore, the lipophilic polymer coupler and a hydrophobic magenta coupler as described above are simultaneously dissolved in an organic solvent, the solution is dispersed in an aqueous gelatin solution, and the resulting mixture can be used.

In order to satisfy the characteristics required of the photographic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the magenta polymer coupler latex according to the present invention in a manner as described in Japanese Patent Application (OPI) No. 39853/76, etc., and the resulting latex can then be used. The above described DIR coupler is loaded into the magenta polymer coupler latex in a manner as described in Japanese Patent Application (OPI) Nos. 59942/76 and 32552/79, U.S. Pat. No. 4,199,363, etc., and the resulting latex can then be used.

Furthermore, a DIR coupler as described above and the lipophilic magenta polymer coupler are simultaneously dissolved in an organic solvent, the solution is dispersed in an aqueous gelatin solution, and the resulting mixture can be used.

Furthermore, the magenta polymer coupler latex according to the present invention can be used together with a DIR compound as described, for example, in West German Patent Application (OLS) Nos. 2,529,350, 2,448,063 and 2,610,546, U.S. Pat. Nos. 3,928,041, 3,958,993, 3,961,959, 4,049,455, 4,052,213, 3,379,529, 3,043,690, 3,364,022, 3,297,445 and 3,287,129, etc.

Moreover, the magenta polymer coupler latex according to the present invention can be used in combination with a colored magenta coupler as described, for example, in U.S. Pat. No. 2,449,966, West German Pat. No. 2,024,186, Japanese Patent Application (OPI) Nos. 123625/74, 131448/74 and 42121/77, etc., a competing coupler as described, for example, in U.S. Pat. Nos. 3,876,428, 3,580,722, 2,998,314, 2,808,329, 2,742,832 and 2,689,793, etc., a stain preventing agent as described, for example, in U.S. Pat. Nos. 2,336,327, 2,728,659, 2,336,327, 2,403,721, 2,701,197 and 3,700,453, etc., a color image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventionally well known coupler(s) other than a magenta color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

A phenol type compound, a naphthol type compound, etc., can be employed as a cyan forming coupler. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 73050/80, etc.

Two or more kinds of the couplers described above can be incorporated into the same layer, or the same coupler compound can also be present in two or more layers.

A known method described, for example, in U.S. Pat. No. 2,322,027, can be used to incorporate the couplers described above into a silver halide emulsion layer. The coupler is dispersed in a hydrophilic colloid and then mixed with a silver halide emulsion. When a coupler having an acid group such as a carboxylic acid group, a sulfonic acid group, etc., is used, it can be incorporated into a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to 3 microns. These silver halide emulsions can be prepared, for example, by a single jet method, by a double jet method or a controlled double jet method, and by a ripening method such as an ammonia method, a neutral method, or an acid method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantly formed on the surface of the grains or of the type where latent images are predominantly formed inside the grains can be used in the present invention. Also, two or more kinds of silver halide photographic emulsions prepared separately and then mixed can be employed.

Examples of useful hydrophilic high molecular weight substances which make up the photographic light-sensitive layer of the present invention include proteins such as gelatin, etc., high molecular weight non-electrolytes such as polyvinyl alcohol, polyvinyl pyrrolidone, polyacrylamide, etc., acidic polymers such as an alginate, a polyacrylic acid salt, etc., high molecular weight ampholites such as a polyacrylamide treated by the Hoffman rearrangement reaction, copolymers of acrylic acid and N-vinylimidazole cross-linkable polymer as described in U.S. Pat. No. 4,215,195. Furthermore, a hydrophobic polymer dispersion such as a latex of polybutyl acrylate, etc., can be included in the continuous phase of such a hydrophilic high molecular weight substance.

The silver halide emulsion used in the present invention can be chemically sensitized using conventional methods. Examples of suitable chemical sensitizers include, for example, gold compounds such as chloroaurates and gold trichloride as described in U.S. Pat. Nos. 2,399,083, 2,540,085, 2,597,856 and 2,597,915; salts of a noble metal, such as platinum, palladium, iridium, rhodium and ruthenium, as described in U.S. Pat. Nos. 2,448,060, 2,540,086, 2,566,245, 2,566,263 and 2,598,079; sulfur compounds capable of forming silver sulfide by reacting with a silver salt, such as those described in U.S. Pat. Nos. 1,574,944, 2,410,689, 3,189,458 and 3,501,313; stannous salts, amines, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing of the photographic light-sensitive material. A wide variety of such compounds are known, such as heterocyclic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Other examples of such compounds which can be used are described in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Patents 893,428, 403,789, 1,173,609 and 1,200,188, as well as in K. Mees, *The Theory of the Photographic Process,* 3rd Ed. (1966) and the literature references cited therein.

The photographic emulsion used in the present invention can also contain one or more surface active agents. These surface active agents are commonly used as a coating aid. However, in some cases they are used for the purpose of emulsified dispersion, sensitization, static preventing, adhesive preventing, etc.

The surface active agents can be classified into various groups, as follows: natural surface active agents such as saponin; nonionic surface active agents such as alkylene oxides, glycerols and glycidols; cationic surface active agents such as higher alkylamines, quaternary ammonium salts, heterocyclic compounds such as pyridine and the like, phosphoniums or sulfoniums; anionic surface active agents containing an acid group such as a carboxylic acid group, a sulfonic acid group, a phosphoric acid group, a sulfuric acid ester group, or phosphoric acid ester group; amphoteric surface active agents such as aminoacids, aminosulfonic acids, aminoalcohol sulfuric acid esters or amino-alcohol phosphoric acid esters. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Patent Application (OLS) No. 1,942,665, British Pat. Nos. 1,077,317 and 1,198,450, as well as Ryohei Oda et al., *Kaimenkasseizai no Gosei to sono Oyo* (*Synthesis and Application of Surface Active Agents*), Maki Shoten (1964), A. W. Perry, *Surface Active Agents,* Interscience Publications, Inc. (1958) and J. P. Sisley, *Encyclopedia of Surface Active Agents,* Vol. II, Chemical Publishing Co. (1964).

The photographic emulsions can be spectrally sensitized, or supersensitized, using a cyanine type dye, such as a cyanine, merocyanine, carbocyanine, etc., individually, in combinations, or in combination with a styrryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the wavelength range to be sensitized or the purposes and use of the photographic materials to be sensitized.

The hydrophilic colloid layer, and in particular, a gelatin layer in the photographic light-sensitive material used in the present invention, can be hardened using various kinds of cross-linking agents. For instance, an inorganic compound such as a chromium salt and a zirconium salt, or an aldehyde type cross-linking agent such as mucochloric acid, or 2-phenoxy-3-chloromalealdehyde acid as described in Japanese Patent Publication No. 1872/71 can be effectively used in the present invention, but non-aldehyde type cross-linking agents such as compounds having plural epoxy rings as described in Japanese Patent Publication No. 7133/59, the poly(1-aziridinyl) compounds as described in Japanese Patent Publication No. 8790/62, the active halogen compounds as described in U.S. Pat. Nos. 3,362,827 and 3,325,287 and the vinyl sulfone compounds as described in U.S. Pat. Nos. 2,994,611 and 3,582,322, Belgian Pat. No. 686,440, etc., are particularly suitable for use in the photographic light-sensitive material of the present invention.

The silver halide photographic emulsion of the present invention is suitably applied to a support. Illustrative supports include rigid materials such as glass, metal and ceramics, and flexible materials and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an $\alpha$-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

The present invention is applicable to not only the so-called multilayer type photographic light-sensitive material comprising a support having superimposed thereon emulsion layers, each of which is sensitive to radiation of a substantially different wavelength region and forms color images of a substantially different hue, but also the so-called mixed-packet type photographic light-sensitive material comprising a support having coated thereon a layer containing packets which are sensitive to radiation of substantially different wavelength regions and form color images of a substantially different hue. The present invention can be applied to a color negative film, a color positive film, a color reversal film, a color printing paper, a color reversal printing paper, and the like.

The color photographic light-sensitive material of the present invention is, after exposure, subjected to development processing to form dye images. Development processing includes basically a color development step, a bleaching step and a fixing step. Each step can be carried out individually, or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above includes a compound capable of developing an exposed silver halide and having a primary amino group on an aromatic ring, and a precursor which forms such compound. Typical examples of preferred developing agnets are, for example, 4-amino-N,N-diethylaniline, 3-methyl-4-amino-N,N-diethylaniline, 4-amino-n-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and the salts thereof (for example, the sulfates, the hydrochlorides, the sulfites, the p-toluene sulfonates, and the like). Other developing agents such as those described in U.S. Pat. Nos. 2,193,015 and 2,592,364, Japanese Patent Application (OPI) No. 64933/73, L. F. A. Mason, *Photographic Processing Chemistry,* pages 226 to 229, Focal Press, London (1966), and T. H. James, *The Theory of the Photographic Process,* 4th Ed., pages 315 to 320, Macmillan, New York (1977), etc., can be used. Further, an aminophenol as described in *The Theory of the Photographic Process,* 4th Ed., pages 311 to 315, etc., may be used. Also, a 3-pyrazolidone can be used together with these developing agents.

The color developer solution can optionally contain various additives. Typical examples of such additives include alkaline agents (for example, alkali metal or ammonium hydroxides, carbonates or phosphates); pH-adjusting agents or buffers (for example, weak acids such as acetic acid, boric acid, etc., weak bases, or salts thereof); developing accelerators (for example, various pyridinium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. No. 2,533,990, 2,577,127 and 2,950,970; nonionic compounds such as polythioethers represented by those described in British Pat. Nos. 1,020,033 and 1,020,032; polymeric compounds having sulfite ester groups such as those described in U.S. Pat. No. 3,068,097; organic amines such as pyridine and ethanolamine; benzyl alcohol; hydrazines and the like); anti-fogging agents (for example, alkali metal bromides; alkali metal iodides; nitrobenzimidazoles such as those described in U.S. Pat. Nos. 2,496,940 and 2,656,271; mercaptobenzimidazole; 5-methylbenzotriazole; 1-phenyl-5-mercaptotetrazole; compounds for use in rapid processing such as those described in U.S. Pat. Nos. 3,113,864, 3,342,596, 3,295,976, 3,615,522 and 3,597,199; thiosulfonyl compounds such as those described in British Pat. No. 972,211; phenazine-N-oxides such as those described in Japanese Patent Publication No. 41675/71; those described in *Kagaku Shashin Binran* (*Manual of Scientific Photography*), Vol. II, pages 29 to 47, and the like; stain or sludge preventing agents such as those described in U.S. Pat. Nos. 3,161,513 and 3,161,514, and British Pat. Nos. 1,030,442, 1,144,481 and 1,251,558; interlayer-effect accelerators disclosed in U.S. Pat. No. 3,536,487; preservatives (for example, sulfites, bisulfites, hydroxyamine, hydrochloride, formsulfite, alkanolaminesulfite adducts, etc) and the like.

The color photographic light-sensitive material of the present invention can be treated with various solutions prior to color development.

In the case of color reversal films, treatment with a first development solution is also carried out prior to color development. As the first development solution, an alkaline aqueous solution containing at least one developing agent, such as hydroquinone, 1-phenyl-3-pyrazolidone, N-methyl-p-aminophenol and the like can be employed. The solution can also contain inorganic salts such as sodium sulfate; pH-adjusting agents or buffers such as borax, boric acid, sodium hydroxide and sodium carbonate; development fog inhibitors such as alkali metal halides (such as potassium bromide, etc.), and the like.

The additives illustrated above and the amounts thereof employed are well known in the color processing field.

After color development, the color photographic materials are usually bleached and fixed. The process can be effected in a blix bath which combines the bleaching and fixing steps. Various compounds can be used as a bleaching agent, for example, ferricyanides, dichromates; water-soluble iron (III) salts, water-soluble cobalt (III) salts; water-soluble copper (II) salts; water-soluble quinones; nitrosophenols; complex salts of a polyvalent cation such as iron (III), cobalt (III), copper (II), etc., and an organic acid, for example, metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and copper complex salt of 2,6-dipicolinic acid; peracids such as alkylperacids, persulfates, permanganates and hydrogen peroxide; hypochlorites; chlorine; bromine; bleaching powder; and the like. These can be suitably used, individually or in combination. To the bleaching solution, bleaching accelerators such as those described in U.S. Pat. Nos. 3,042,520 and 3,241,966, Japanese Patent Publication Nos. 8506/70 and 8836/70 and various other additives can be added.

Any known fixing solution can be used for fixing the photographic material of the present invention. That is, ammonium sodium, or potassium thiosulfate can be used as a fixing agent at a concentration of about 50 to about 200 g/liter. Fixing solutions can further contain stabilizers such as sulfites and metabisulfites; hardeners such as potassium alum; pH buffers such as acetates and borates, and the like. The fixing solution generally has a pH of more than 3 or less.

Bleaching baths, fixing baths and blixing baths as described, for example, in U.S. Pat. No. 3,582,322, Japanese Patent Application (OPI) No. 101934/73, West German Patent 1,051,117 can also be employed.

The present invention will be explained in greater detail with reference to the following examples, but the present invention should not be construed as being limited thereto.

EXAMPLE 1

Emulsion Layer of Samples 1, 2, 3 and 4

33 g of Polymer Coupler Latex (B') prepared using Lipophilic Polymer Coupler (B) was mixed with 100 g of a silver halide emulsion containing $5.6\times10^{-2}$ mol of silver iodobromide and 10 g of gelatin. To the mixture was added 8 ml of a 4% acetone solution of 2-hydroxy-4,6-dichloro-s-triazine sodium salt. After adjusting the pH to 6.5, the mixture was coated on a cellulose triacetate film support having a subbing layer.

Emulsion Layer of Samples 5, 6, 7 and 8

8 g of an oil-soluble 4-equivalent Magenta Coupler (C-1) and 6 ml of tricresyl phosphate were dissolved by heating in 40 ml of ethyl acetate and the solution was added to 100 ml of an aqueous solution containing 10 g of gelatin and 0.4 g of sodium lauryl sulfate. The resulting mixture was stirred using a homogenizer to prepare a dispersion. 70 g of thus-prepared dispersion was mixed with 100 of a silver halide emulsion containing $5.6\times10^{-2}$ mol of silver iodobromide and 10 g of gelatin. To the mixture was added 8 ml of a 4% acetone solution of 2-hydroxy-4,6-dichloro-s-triazine sodium salt. After adjusting the pH to 6.5, the mixture was coated on a film support same as described for Samples 1 to 4.

Protective Layer of Samples 1 and 5

30 ml of a 10% by weight methanol solution of Formalin Scavenger (S-5) was mixed with 200 ml of an aqueous solution containing 15 g of gelatin. The mixture was coated in an amount of Formalin Scavenger (S-5) of 0.3 g/m$^2$ on the emulsion layer of Samples 1 and 5 as a protective layer.

Protective Layer of Samples 2 and 6, and Samples 3 and 7

In place of Formalin Scavenger (S-5) used in Samples 1 and 5, Formalin Scavengers (S-6) and (S-12) were used, respectively.

Protective Layer of Samples 4 and 8

A gelatin protective layer was coated on the emulsion layer of Samples 4 and 8 so as to render the same amount of gelatin as that of the protective layer of Samples 1 to 3 and Samples 5 and 7.

Samples 1 to 8 described above were brought into contact with formaldehyde vapor of (A) 0 ppm and (B) 10 ppm, respectively, for 24 hours under the conditions of 40° C. and 70% relative humidity. Then, the samples were exposed to light and subjected to the following color development processing.

| Color Development Processing Step | Time | Temperature (°C.) |
|---|---|---|
| 1. Color development | 3 min 15 sec | 38 |
| 2. Bleaching | 6 min 30 sec | " |
| 3. Washing with water | 2 min | " |
| 4. Fixing | 4 min | " |
| 5. Washing with water | 4 min | " |
| 6. Stabilizing | 1 min | " |

The process solutions used in the color development processing had the following compositions:

| | |
|---|---|
| **Color Developer Solution** | |
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |
| **Bleaching Solution** | |
| Water | 800 ml |
| Iron (III) Ammonium Ethylenediaminetetraacetate | 100 g |
| Disodium Ethylenediaminetetraacetate | 10 g |
| Potassium Bromide | 150 g |
| Acetic Acid | 10 g |
| Water to make | 1 l |
| | (pH 6.0) |
| **Fixing Solution** | |
| Water | 800 ml |
| Ammonium Thiosulfate | 150 g |
| Sodium Sulfite | 10 g |
| Sodium Hydrogen Sulfite | 2.5 g |
| Water to make | 1 l |
| | (pH 6.0) |
| **Stabilizing Bath** | |
| Water | 800 ml |
| Formalin (37 wt % formaldehyde) | 5 ml |
| Drywell | 3 ml |
| Water to make | 1 l |

The rate of decrease in maximum magenta color density (Dm)

$$1-\frac{Dm^B}{Dm^A}$$

due to formalin and the rate of recovery of magenta density by the addition of formalin scavenger to the protective layer are shown in Table 1 below. Also, in Table 1, the relative film strength of these coated samples is set forth. The relative film strength was determined by the following method. A needle having a steel ball (0.1 mm in radius) attached thereto was pressed against a surface of the sample and was moved parallel on the surface of the membrane at 5 mm/sec, with the load applied to the needle varying continuously in the range of from 0 to 200 g. The load that the needle penetrated to the surface of support of the sample was measured. Taking the critical load of Sample 1 as 100, those of other samples are shown.

TABLE 1

| Sample | Coupler | Formalin Scavenger | $1-\frac{Dm^B}{Dm^A}$ (%) | Rate of Recovery | Relative Film Strength |
|---|---|---|---|---|---|
| 1 (Present Invention) | (B') | (S-5) | 9 | 31 | 100 |
| 2 (Present Invention) | " | (S-6) | 16 | 24 | 96 |
| 3 (Present Invention) | " | (S-12) | 13 | 27 | 98 |
| 4 (Comparison) | " | — | 40 | — | 105 |
| 5 (Comparison) | (C-1) | (S-5) | 20 | 18 | 85 |
| 6 (Comparison) | " | (S-6) | 26 | 12 | 81 |
| 7 (Comparison) | " | (S-12) | 22 | 16 | 82 |
| 8 (Comparison) | " | — | 38 | — | 95 |

$Dm^A$: Maximum color density (Dm) under Condition (A), i.e., without formalin
$Dm^B$: Maximum color density (Dm) under Condition (B), i.e., with formalin
Rate of Recovery:

Rate of recovery of $\frac{Dm^B}{Dm^A}$ by the addition of formalin scavenger with respect to the same coupler From the results as shown in Table 1 above, it is apparent that the rate of decrease in color density diminishes by the addition of formalin scavenger and the density recovery improving effect due to Formalin Scavengers (S-5), (S-6) and (S-12) is remarkably large when the formalin scavengers were applied to the 4-equivalent magenta polymer coupler latex according to the present invention in comparison with the cases wherein the formalin scavengers were applied to the oil-soluble 4-equivalent magenta coupler. The degradation of the film strength by the addition of formalin scavenger in the case wherein the polymer coupler latex is used is prevented in comparison with the oil-soluble 4-equivalent magenta coupler.

The oil-soluble 4-equivalent Magenta Coupler (C-1) for comparison has the following formula.

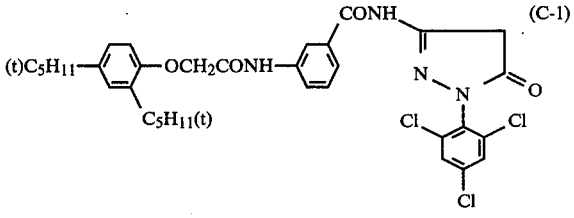

EXAMPLE 2

10 g of each of lipophilic 4-equivalent Magenta Polymer Couplers (L) and (K) was dissolved in 100 ml of ethyl acetate at 40° C. and the solution was added to 100 ml of an aqueous solution containing 10 g of gelatin and 0.3 g of sodium triisopropylnaphthalenesulfonate. The resulting mixture was stirred using a homogenizer to prepare a dispersion and ethyl acetate was removed under a reduced pressure to obtain 84 g and 82 g of Polymer Coupler Latexes (L') and (K'), respectively.

Each of 4-equivalent Magenta Polymer Coupler Latexes (III) and (IX) and Lipophilic Polymer Coupler Latexes (L') and (K') prepared described above was mixed with a silver iodobromide emulsion and coated on a cellulose triacetate film having a subbing layer in the same manner as described in Example 1 to prepare an emulsion layer of Samples 9 and 13, Samples 10 and 14, Samples 11 and 15 and Samples 12 and 16, respectively.

8 g of each of an oil-soluble 4-equivalent Coupler Monomers (C-2), (C-3) and (C-4) for comarison and 8 ml of dibutyl phthalate were dissolved by heating in 40 ml of ethyl acetate and the solution was added to 100 ml of an aqueous solution containing 12 g of gelatin and 0.3 g of sodium triisopropylnaphthalenesulfonate. The resulting mixture was dispersed using a homogenizer. Each 60 g, 66 g and 64 g of the dispersions were mixed with a silver halide emulsion containing $5.6\times10^{-2}$ mol of silver iodobromide emulsion and 10 g of gelatin followed by the method as described in Example 1 to prepare an emulsion layer of Samples 17 and 20, Samples 18 and 21 and Samples 19 and 22, respectively.

A protective layer of Samples 9 to 12 and Samples 17 to 19 was prepared by coating Formalin Scavenger (S-5) in the same manner as described in Example 1.

A protective layer of Samples 13 to 16 and Samples 20 to 22 was prepared by coating so as to render a protective layer which did not contain the formalin scavenger same as described in Example 1.

Samples 9 to 22 described above were brought into contact with formaldehyde vapor of (A) 0 ppm and (B) 20 ppm, respectively, for 24 hours under the condition of 45° C. and 70% relative humidity. Then, the samples were exposed to light and subjected to the same color development processing as described in Example 1.

The rate of decrease in maximum color density of the condition (B) against the condition (A) and the rate of recovery of magenta color density by the addition of formalin scavenger are shown in Table 2 below.

TABLE 2

| Sample | Coupler | Formalin Scavenger | $1-\frac{Dm^B}{Dm^A}$ (%) | Rate of Recovery |
|---|---|---|---|---|
| 9 (Present Invention) | (III) | (S-5) | 35 | 20 |
| 10 (Present Invention) | (IX) | (S-5) | 16 | 22 |
| 11 (Present Invention) | (L') | (S-5) | 14 | 22 |
| 12 (Present Invention) | (K') | (S-5) | 54 | 17 |
| 13 (Comparison) | (III) | — | 55 | — |
| 14 (Comparison) | (IX) | — | 38 | — |
| 15 (Comparison) | (L') | — | 36 | — |
| 16 (Comparison) | (K') | — | 71 | — |
| 17 (Comparison) | (C-2) | (S-5) | 33 | 10 |
| 18 (Comparison) | (C-3) | (S-5) | 29 | 6 |
| 19 (Comparison) | (C-4) | (S-5) | 59 | 8 |
| 20 (Comparison) | (C-2) | — | 43 | — |
| 21 (Comparison) | (C-3) | — | 65 | — |
| 22 (Comparison) | (C-4) | — | 67 | — |

From the results as shown in Table 2 above, it is apparent that the improvement in the formalin resistivity by the addition of formalin scavenger is clearly large when the formalin scavenger was applied to the 4-equivalent magenta polymer coupler latexes according to the present invention in comparison with the cases wherein the formalin scavenger was applied to the oil-soluble 4-equivalent magenta couplers.

The oil-soluble 4-equivalent Magenta Couplers (C-2), (C-3) and (C-4) for comparison have the following formulae, respectively.

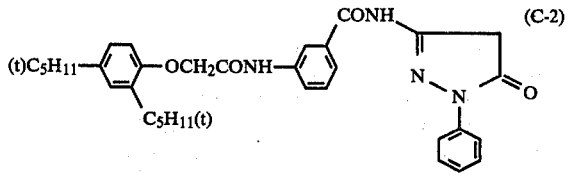

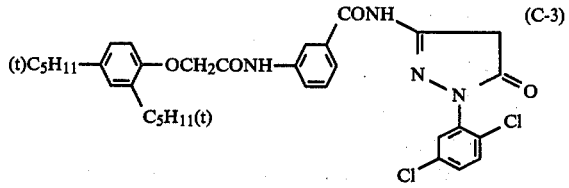

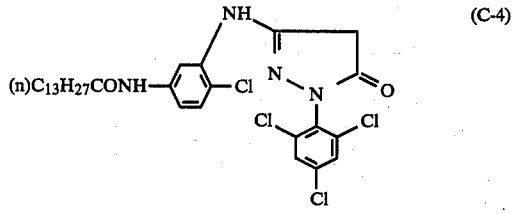

EXAMPLE 3

10 g of each of lipophilic 4-equivalent Magenta Polymer Couplers (H) and (Q) was dissolved in 80 ml of ethyl acetate at 38° C. and the solution was added to 100 ml of an aqueous solution containing 10 g of gelatin and 0.3 g of sodium dodecylbenzenesulfonate. The resulting mixture was stirred using a homogenizer to prepare a dispersion and ethyl acetate was removed under a reduced pressure to obtain 87 g and 86 g of Polymer Coupler Latexes (H') and (Q'), respectively.

Each of Polymer Coupler Latexes (H') and (Q') prepared described above and 4-equivalent Magenta Polymer Coupler Latexes (VIII) and (X) in a coupler unit amount of $7.5\times10^{-3}$ mol was mixed with 100 g of silver halide emulsion containing $8.4\times10^{-2}$ mol of silver iodobromide and 10 g of gelatin, and to the mixture was added 8 ml of a 4% acetone solution of 2-hydroxy-4,6-dichloro-s-triazine sodium salt. After adjusting the pH to 6.7, the mixture was coated on a cellulose triacetate film support in an amount of silver coated of $1.2\times10^{-3}$ mol/m$^2$ to prepare an emulsion layer of Samples 23 and 28, Samples 24 and 29, Samples 25 and 30, and Samples 26 and 31.

10 g of an oil-soluble 4-equivalent Magenta Coupler (C-5) for comparison and 5 ml of tricresyl phosphate were dissolved by heating in 50 ml of ethyl acetate and the solution was added to an aqueous solution containing 25 g of gelatin and 1.0 g of sodium dodecylbenzenesulfonate. The resulting mixture was stirred using a homogenizer to prepare a dispersion. 130 g of the dispersion was mixed with 100 g of a silver iodobromide emulsion described above followed by coating the mixture as described for the coating method of the emulsion layer of Samples 23 to 26 and Samples 28 to 31 to prepare an emulsion layer of Samples 27 and 32.

10 ml of a 20% by weight methanol solution of Formalin Scavenger (S-4) was mixed with an aqueous gelatin solution containing 15 g of gelatin and the resulting mixture was coated in an amount of 0.4 g/m$^2$ of Formalin Scavenger (S-4) on the emulsion layer of Samples 23 and 27 to prepare a protective layer.

A gelatin protective layer was coated on the emulsion layer of Samples 28 to 32 so as to render the same coating amount of gelatin as that of the protective layer of Samples 23 and 27 described above.

Samples 23 and 32 described above were brought into contact with formaldehyde vapor of (A) 0 ppm and (B) 20 ppm, respectively, for 24 hours under the conditions of 40° C. and 70% relative humidity. Then, the samples were exposed to light and subjected to the following color development processing.

| Color Development Processing Step (38° C.) | Time (min) |
|---|---|
| 1. First development | 3 |
| 2. Washing with water | 1 |
| 3. Reversal | 2 |
| 4. Color development | 6 |
| 5. Controlling | 2 |
| 6. Bleaching | 6 |
| 7. Fixing | 4 |
| 8. Washing with water | 4 |
| 9. Stabilizing | 1 |
| 10. Drying | |

The processing solutions used in the color development processing had the following compositions:

| | |
|---|---|
| **First Development Solution** | |
| Water | 800 ml |
| Sodium Tetrapolyphosphate | 2.0 g |
| Sodium Hydrogen Sulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.5 g |
| Potassium Bromide | 1.5 g |
| Potassium Iodide | 13.0 mg |
| Sodium Thiocyanate | 1.4 g |
| Water to make | 1 l |
| **Reversal Solution** | |
| Water | 800 ml |
| Hexasodium Nitrilo-N,N,N—trimethylene Phosphonate | 3.0 g |
| Stannous Chloride Dihydrate | 1.0 g |
| Sodium Hydroxide | 8.0 g |
| Glacial Acetic Acid | 15.0 ml |
| Water to make | 1 l |
| **Color Development Solution** | |
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazic Acid | 1.5 g |
| 4-Amino-3-methyl-N—ethyl-N—(β-hydroxyethyl)aniline Sesquisulfate Monohydrate | 11.0 g |
| Ethylenediamine | 3.0 g |
| Water to make | 1 l |
| **Controlling Solution** | |
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1 l |
| **Bleaching Solution** | |
| Water | 800 ml |
| Sodium Ethylenediaminetetraacetate Dihydrate | 2.0 g |
| Ammonium Iron (II) Ethylenediaminetetraacetate Dihydrate | 120.0 g |
| Potassium Bromide | 100.0 g |

-continued

| | |
|---|---|
| Water to make | 1 l |
| Fixing Solution | |
| Water | 800 ml |
| Ammonium Thiosulfate | 80.0 g |
| Sodium Sulfite | 5.0 g |
| Sodium Hydrogen Sulfite | 5.0 g |
| Water to make | 1 l |
| Stabilizing Bath | |
| Water | 800 ml |
| Formalin (37 wt % formaldehyde) | 5.0 ml |
| Fuji Drywell | 5.0 ml |
| Water to make | 1 l |

The rate of decrease in color density of the condition (B) against color density of the condition (A) and the rate of recovery of magenta color density by the addition of formalin scavenger are shown in Table 3 below.

TABLE 3

| Sample | Coupler | Formalin Scavenger | $1-\frac{Dm^B}{Dm^A}$ (%) | Rate of Recovery of Magenta Color Density of Addition of Formalin Scavenger (%) |
|---|---|---|---|---|
| 23 (Present Invention) | (H') | (S-4) | 33 | 19 |
| 24 (Present Invention) | (Q') | (S-4) | 35 | 19 |
| 25 (Present Invention) | (VIII) | (S-4) | 29 | 21 |
| 26 (Present Invention) | (X) | (S-4) | 30 | 24 |
| 27 (Comparison) | (C-5) | (S-4) | 45 | 10 |
| 28 (Comparison) | (H') | — | 52 | — |
| 29 (Comparison) | (Q') | — | 54 | — |
| 30 (Comparison) | (VIII) | — | 50 | — |
| 31 (Comparison) | (X) | — | 54 | — |
| 32 (Comparison) | (C-5) | — | 55 | — |

From the results as shown in Table 3 above, it is apparent that the improvement in the formalin resistivity by the addition of formalin scavenger is remarkably large when the formalin scavenger was applied to the 4-equivalent magenta polymer coupler latexes according to the present invention in comparison with the cases wherein the formalin scavenger was applied to the oil-soluble 4-equivalent magenta coupler for comparison.

The oil-soluble 4-equivalent Magenta Coupler (C-5) for comparison has the following formula.

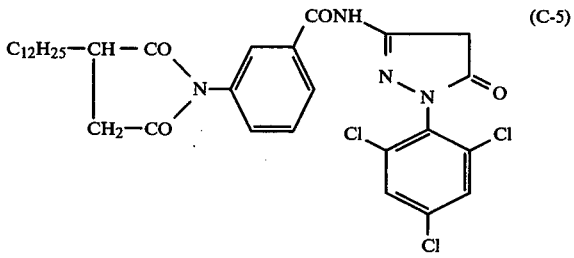

EXAMPLE 4

Using 4-equivalent Magenta Polymer Coupler Latex (B'), a coating composition for the third layer was prepared in the same manner as described in Example 1. Sample 33 having a multilayer structure as shown below was prepared using the coating composition for the third layer. In the following, the coating amount of each component is set forth in parentheses.

The Sixth Layer: Protective layer containing gelatin (1.00 g/m$^2$) and Formalin Scavenger (S-5) (0.4 g/m$^2$)

The Fifth Layer: Blue-sensitive layer containing a silver iodobromide emulsion (1.0 g/m$^2$), a yellow coupler[5] (1.0 g/m$^2$), a coupler solvent[3] (0.5 g/m$^2$) and gelatin (1.5 g/m$^2$).

The Fourth Layer: Intermediate layer containing gelatin (1.2 g/m$^2$)

The Third Layer: Green-sensitive layer containing a silver iodobromide emulsion (1.5 g/m$^2$), Magenta Polymer Coupler Latex (B') (0.8 g/m$^2$)[4] and gelatin (1.5 g/m$^2$)

The Second Layer: Intermediate layer containing gelatin (1.2 g/m$^2$)

The First Layer: Red-sensitive layer containing a silver iodobromide emulsion (2.0 g/m$^2$ of silver), a cyan coupler[2] (1.0 g/m$^2$), a coupler solvent (0.5 g/m$^2$) and gelatin (2.0 g/m$^2$)

Support[1]

(1) Support: Cellulose triacetate film having a subbing layer (2) Cyan coupler:

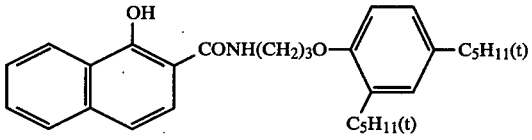

(3) Coupler solvent: Dibutyl phthalate (4) Coating amount of magenta coupler: A coating amount of Lipophilic Polymer Coupler (B)

(5) Yellow coupler:

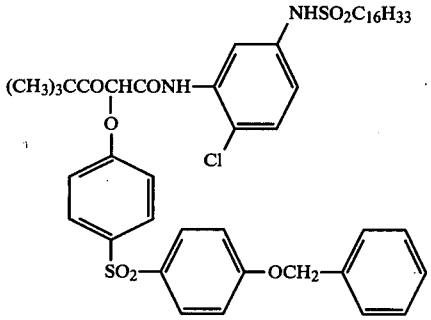

This sample was brought into contact with formaldehyde vapor or (A) 0 ppm and (B) 20 ppm, respectively, for 24 hours under the conditions of 40° C. and 70% relative humidity. Then the sample was imagewise exposed to light through a green filter and subjected to the same color development processing as described in Example 3. As a result, it was found that the maximum magenta densities of Condition (A) and Condition (B) were 2.56 and 2.18, respectively.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material, comprising:

a support base;

a silver halide emulsion layer on the base;

a 4-equivalent magenta color image forming polymer coupler latex being a polymer or copolymer having a repeating unit derived from a monomer coupler represented by formula (III)

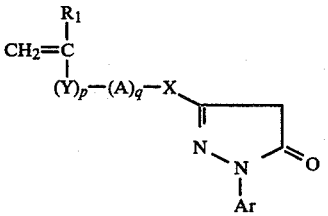

(III)

wherein R represents a hydrogen atom, a lower alkyl group containing from 1 to 4 carbon atoms, or a chlorine atom; X represents —CONH—, —NH—, —NHCONH— or —NHCOO—; Y represents —CONH— or —COO—; A represents an unsubstituted or substituted alkylene group containing from 1 to 10 carbon atoms in the alkylene moiety or an unsubstituted or substituted phenyl group; Ar represents an unsubstituted or substituted phenyl group; p represents 0 to 1; and q represents 0 or 1; and a compound capable of reacting with and fixing formaldehyde gas, and being represented by the following general formulae (I) or (II):

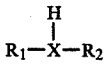

(I)

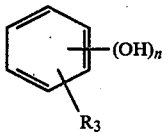

(II)

wherein $R_1$ and $R_2$, which may be the same or different, each represents a hydrogen atom, an alkyl group, a substituted alkyl group, an aryl group, a substituted aryl group, an acyl group, an alkoxycarbonyl group, a carbamoyl group or an amino group, or $R_1$ and $R_2$ may be bonded each other to form a ring and at least one of $R_1$ and $R_2$ is an acyl group, an alkoxycarbonyl group, a carbamoyl group or an amino group; and X represents —CH— or —N—; $R_3$ represents an alkyl group, a substituted alkyl group, an aryl group or a substituted aryl group or an atomic group necessary to form a monocyclic ring fused to the benzene ring; and n represents an integer of not less than 2, and has not more than 300 of an equivalent molecular weight per unit of an active hydrogen atom as defined below:

$$\text{Equivalent Molecular Weight} = \frac{\text{Molecular Weight}}{\text{Number of Active Hydrogen Atoms in Molecule}}$$

2. A silver halide color photographic light-sensitive material as claimed in claim 1, wherein the compound represented by the general formulae (I) and (II) is a compound represented by the following general formulae (I-1) to (I-7) and (II-1) to (II-2) including a compound capable of converting to an enol form

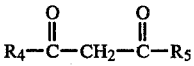

(I-1)

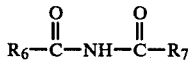

(I-2)

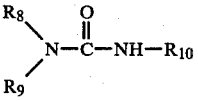

(I-3)

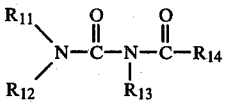

(I-4)

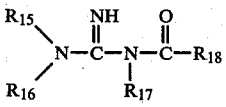

(I-5)

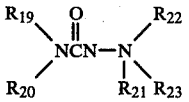

(I-6)

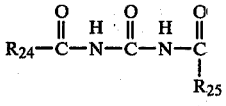

(I-7)

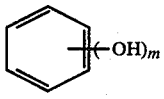

(II-1)

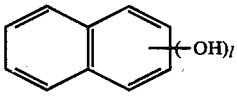

(II-2)

wherein $R_4$ to $R_{25}$ each represents a hydrogen atom, an alkyl group, a substituted alkyl group, an aryl group or a substituted aryl group and at least one of $R_{11}$, $R_{12}$, $R_{13}$ and $R_{14}$ and at least one of $R_{19}$, $R_{20}$, $R_{21}$, $R_{22}$ and $R_{23}$ represents a hydrogen atom, $R_4$ and $R_5$, $R_6$ and $R_7$, and $R_{24}$ and $R_{25}$ may be bonded each other to form a ring, and two substituents selected from $R_8$ to $R_{10}$, $R_{11}$ to $R_{14}$, $R_{15}$ to $R_{18}$ and $R_{19}$ to $R_{23}$ may be bonded each other to form a ring, m represents an integer of from 3 to 6 and l represents an integer of not less than 2.

3. A silver halide color photographic light-sensitive material as claimed in claim 1, further comprising a subbing layer, a protective layer, and intermediate layer, and a filter layer, wherein the compound capable of reacting with and fixing formaldehyde gas is present within the silver halide emulsion layer.

4. A silver halide color photographic light-sensitive material as claimed in claim 1, wherein an amount of the compound capable of reacting with and fixing formaldehyde gas is in a range of from 0.01 g to 10 g per square meter of the photographic light-sensitive material.

5. A silver halide color photographic light-sensitive material as claimed in claim 1, wherein an amount of the compound capable of reacting with and fixing formaldehyde gas is in a range of from 0.05 g to 5 g per square meter of the photographic light-sensitive material.

6. A silver halide color photographic light-sensitive material as claimed in claim 5, wherein the substituent for the alkylene group or the phenylene group represented by A is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, or a sulfonyl group.

7. A silver halide color photographic light-sensitive material as claimed in claim 5, wherein the substituent for the phenyl group represented by Ar is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

8. A silver halide color photographic light-sensitive material as claimed in claim 1, wherein the substituent for the phenyl group represented by Ar is a halogen atom, an alkyl group, an alkoxy group, an alkoxycarbonyl group, or a cyano group.

9. A silver halide color photographic light-sensitive material as claimed in claim 1, wherein the polymer is a homopolymer.

10. A silver halide color photographic light-sensitive material as claimed in claim 1, wherein the polymer is a copolymer.

11. A silver halide color photographic light-sensitive material as claimed in claim 10, wherein the copolymer contains a repeating unit derived from a non-color forming monomer which does not couple with an oxidation product of an aromatic primary amine developing agent.

12. A silver halide color photographic light-sensitive material as claimed in claim 11, wherein the non-color forming monomer is an acrylic acid ester, an acrylic acid amide, a vinyl ester, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

13. A silver halide color photographic light-sensitive material as claimed in claim 11, wherein the non-color forming monomer is an acrylic acid ester, a methacrylic acid ester or a maleic acid ester.

14. A silver halide color photographic light-sensitive material as claimed in claim 1, wherein the amount of the color forming portion in the magenta polymer coupler latex is from 5% to 80% by weight.

15. A silver halide color photographic light-sensitive material as claimed in claim 1, wherein the amount of the color forming portion in the magenta polymer coupler latex is from 20% to 70% by weight.

16. A silver halide color photographic light-sensitive material as claimed in claim 14, wherein the gram number of the magenta polymer coupler latex containing 1 mol of coupler monomer is from 250 to 3,000.

17. A silver halide color photographic light-sensitive material as claimed in claim 1, wherein the magenta polymer coupler latex is a latex prepared by an emulsion polymerization method.

18. A silver halide color photographic light-sensitive material as claimed in claim 1, wherein the magenta polymer coupler latex is a latex prepared by dissolving a lipophilic polymer coupler obtained by polymerization of a monomer coupler in an organic solvent and then dispersing the solution in a latex form in an aqueous gelatin solution.

19. A silver halide color photographic light-sensitive material as claimed in claim 1, wherein the silver halide emulsion layer is a green-sensitive silver halide emulsion layer.

20. A silver halide color photographic light-sensitive material as claimed in claim 19, wherein the silver halide emulsion layer further contains the compound capable of reacting with and fixing formaldehyde gas.

21. A silver halide color photographic light-sensitive material as claimed in claim 20, wherein the photographic light-sensitive material further comprises a blue-sensitive silver halide emulsion layer containing a yellow color image forming coupler and a red-sensitive silver halide emulsion layer containing a cyan color image forming coupler.

* * * * *